United States Patent [19]

Crawford

[11] 4,190,282

[45] Feb. 26, 1980

[54] OTTOMAN PROTECTING DEVICE

[75] Inventor: Allan H. Crawford, Amsterdam, N.Y.

[73] Assignee: Mohasco Corporation, Amsterdam, N.Y.

[21] Appl. No.: 754,219

[22] Filed: Dec. 27, 1976

[51] Int. Cl.[2] ..... A47C 1/02

[52] U.S. Cl. ..... 297/68

[58] Field of Search ..... 74/612, 614, 615; 297/68, 75, 84, 85; 248/345.1

[56] References Cited

U.S. PATENT DOCUMENTS

| | | | |
|---|---|---|---|
| 1,385,237 | 7/1921 | Woodward | 74/615 |
| 3,083,996 | 4/1963 | Caldemeyer | 297/75 |
| 3,572,820 | 3/1971 | Ferguson | 297/84 |
| 3,781,060 | 12/1973 | Pentzien | 297/68 |
| 3,815,440 | 7/1974 | Mikulin | 74/612 |
| 3,915,528 | 10/1975 | Glickman | 248/345.1 |

*Primary Examiner*—James T. McCall

*Attorney, Agent, or Firm*—Joseph P. Flanagan

[57] ABSTRACT

The invention relates to protective guard means for shielding the ottoman structure on a chair when the ottoman is extended. The guard structure is carried on the ottoman and when the ottoman is extended the guard structure is moved to operative position to shield the edge of the ottoman facing the chair's occupant.

3 Claims, 3 Drawing Figures

OTTOMAN PROTECTING DEVICE

The present invention refers to a protective device useful in connection with chairs of the type having an extensible ottoman structure wherein the ottoman is extended from beneath or in front of the forward position of the chair to allow an occupant of the chair to rest his feet upon the ottoman.

In prior art chairs of this type, it frequently happens that the occupant of the chair will rest his feet upon the sidewall of the ottoman structure and cause the fabric on it to wear.

By use of the device of the present invention, a guard structure is automatically disposed in protective relationship to the ottoman to prevent such wear.

Figure 1:
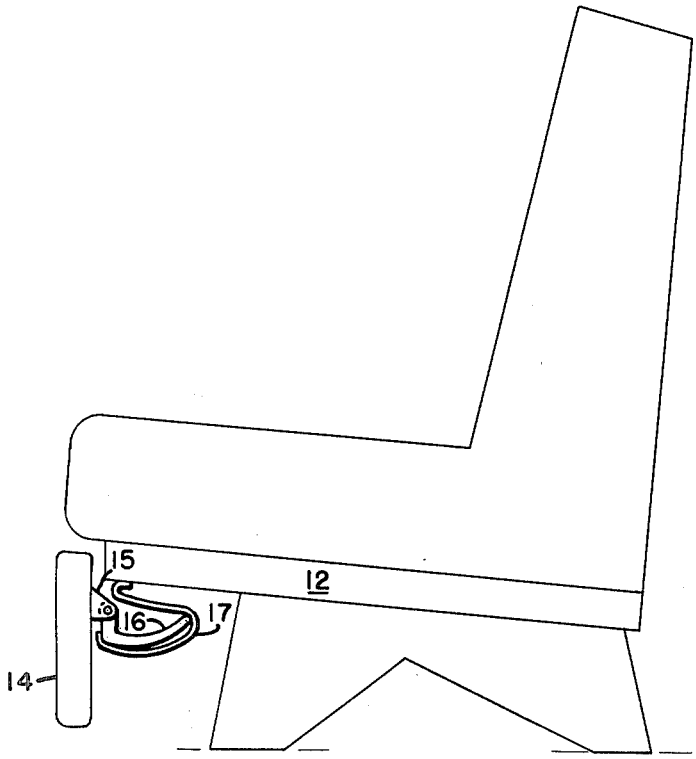
Figure 2:
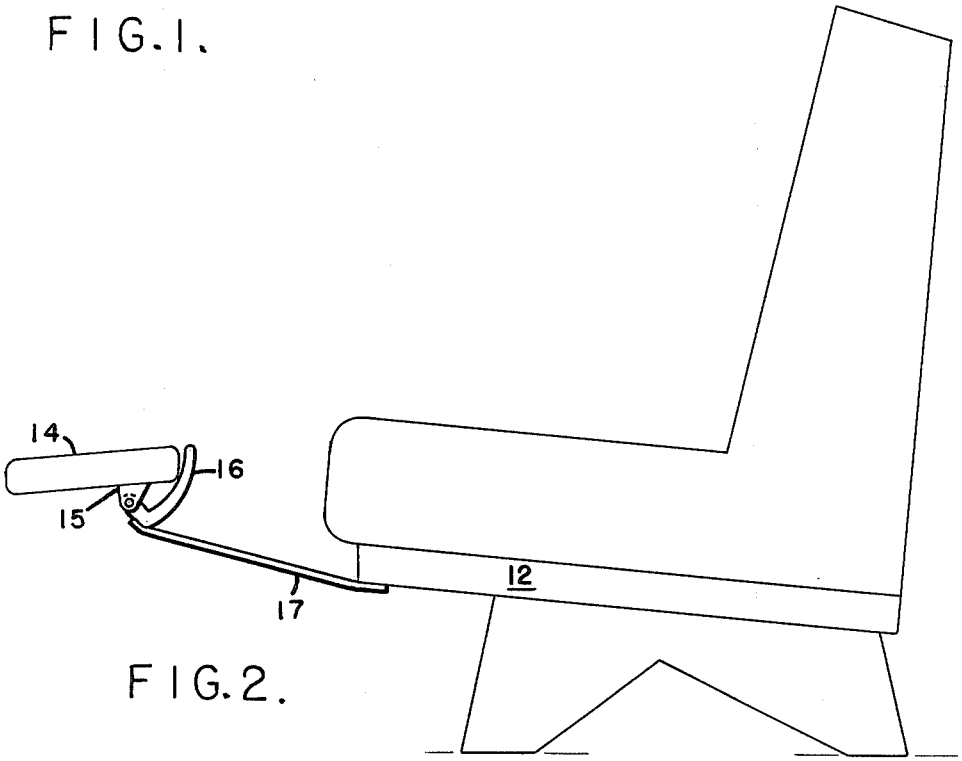

The objects and advantages of the invention will become readily apparent from the following description taken in connection with the accompanying drawings wherein:

FIG. 1 is a schematic view of the device of the instant invention in non-operative position, and FIG. 2 is an illustration of the device of the present invention in its extended ottoman protecting disposition.

Since the overall chair structure of a chair of the type to which this invention may be applied does not form part of the instant invention, such a chair is shown only schematically.

Affixed to the lower portion of the front supporting structure of the chair 12, is an ottoman structure 14 which may carry any suitable and appropriate linkage or connecting device 15. Loosely rotatably mounted on a link member 15 is a protective guard member 16. An actuating member 17 which may be fabric is secured to the protective guard 16 and the chair structure 12.

When the ottoman is extended by its supporting structure, not shown, the ottoman moves forwardly and upwardly away from the lower front portion of the chair. The fabric member 17 will be drawn taut and, as this happens, the fabric member 17 will exert a force upon the protective member 16 to rotate it counterclockwise, FIGS. 1 and 2, to position the distal end of the protective member in overlying relationship to the facing edge of the ottoman whereupon the facing edge of the ottoman will be protected against frictional wear of the type hereinabove described.

When the ottoman is returned from its extended position the fabric member 17 will be relaxed thus allowing the protective member 16 to rotate clockwise about its pivot on the link member 16 and out of protective overlying relationship with respect to the facing edge of the ottoman.

Although in the instant disclosure I have shown a preferred embodiment of my invention, a range of alteration, modification, change, and substitution is intended therein and in some instances some features of the invention will be utlized without a corresponding use of other features. For example, although in the instant embodiment I actuate the ottoman by means of the fabric member 17, the actuating mechanism for moving the blocking member into operative blocking position upon reclining movement of the chair could well take the form of a linkage assembly interconnected between a reclining chair linkage mechanism or the ottoman extending mechanism, both of which mechanisms are well known in the art, and the blocking member. Accordingly, it is intended that the claims be construed in a manner consistent with the full range of the spirit and scope of the invention herein.

Having thus described my invention, I claim:

1. A guard member for protecting a fabric or other covering on a portion of the surface on an ottoman against wear, said guard member rotatably carried on an ottoman, said ottoman being carried on and cooperative with a chair, actuating means connected to said guard member, said guard member movable from a first position wherein the distal end of said guard member is positioned beneath said chair and spaced from said ottoman, to a second position wherein the distal end of said guard member is positioned in overlying relationship to a facing edge portion of said ottoman.

2. A guard member for protecting a fabric or other covering on a portion of the surface of an ottoman against wear, said guard member rotatably carried on an ottoman, said ottoman being carried on and cooperative with a reclining chair, actuating means connected to said guard member, said guard member movable from a first position wherein the distal end of said guard member is positioned beneath said chair and spaced from said ottoman, to a second position wherein the distal end of said guard member is positioned in overlying relationship to a facing edge portion of said ottoman.

3. A guard member for protecting a fabric or other covering on a portion of the surface of an ottoman against wear, said guard member rotatably carried on an ottoman, said ottoman being carried on and cooperative with a reclining chair structure, actuating means interconnected between said guard member and said chair structure, said guard member movable upon reclining movement of said chair from a first position wherein the distal end of said guard member is positioned beneath said chair and spaced from said ottoman, to a second position wherein the distal end of said guard member is positioned in overlying relationship to a facing edge portion of said ottoman, said guard member movable upon movement of said chair from a reclining position to an upright position from said second position to said first position.

* * * * *